US006918855B2

(12) United States Patent
Dumont

(10) Patent No.: US 6,918,855 B2
(45) Date of Patent: Jul. 19, 2005

(54) SKATING TRAINING AID

(76) Inventor: Marc Dumont, 22, Lussier, Delson, Quebec (CA), J0L 1G0

( * ) Notice: Subject to any disclaimer, the term of this patent is extended or adjusted under 35 U.S.C. 154(b) by 21 days.

(21) Appl. No.: 10/378,807

(22) Filed: Mar. 3, 2003

(65) Prior Publication Data

US 2003/0181296 A1 Sep. 25, 2003

Related U.S. Application Data

(60) Provisional application No. 60/360,714, filed on Mar. 4, 2002.

(51) Int. Cl.[7] ..... A63B 71/00

(52) U.S. Cl. ..... 482/51; 482/74; D21/224

(58) Field of Search ..... 482/51, 66, 68, 482/74, 93, 94, 148, 909; 472/15; D21/760, 761, 763; 473/441, 445; 280/47.371, 79.6

(56) References Cited

U.S. PATENT DOCUMENTS 329,989 A * 11/1885 Woodworth ..... 472/15
3,235,254 A * 2/1966 Robson ..... 482/66
3,873,089 A * 3/1975 Krug ..... 473/445
4,021,033 A 5/1977 Auclair et al.
4,140,315 A * 2/1979 Page, Jr. ..... 473/445
4,915,373 A * 4/1990 Walker ..... 482/51
5,120,286 A 6/1992 Twohig
5,385,523 A * 1/1995 Forrest ..... 473/445
D357,522 S * 4/1995 Garneau ..... D21/771
D389,543 S * 1/1998 Morning ..... D21/760
5,810,697 A * 9/1998 Joiner ..... 482/68
5,911,650 A 6/1999 Cox
6,090,015 A * 7/2000 Meyers ..... 482/54
6,537,077 B1 * 3/2003 Johnson ..... 434/258
6,692,417 B2 * 2/2004 Burrell ..... 482/142
6,761,650 B1 * 7/2004 Dettmann ..... 473/445

* cited by examiner

*Primary Examiner*—Justine R. Yu
*Assistant Examiner*—Tam Nguyen

(57) ABSTRACT

A skating training aid consisting of a base plate that slides on the ice—or rolls on any other less slippery surface—and is made of a series of telescoping adjustable rods and the said device can also accept weight plates to adjust the level of strength required to push it while practicing skating movements.

14 Claims, 7 Drawing Sheets

SKATING TRAINING AID

This application claims priority based on provisional application 60/360,714 filed Mar. 4, 2002.

BACKGROUND OF THE INVENTION

1. Field of the Invention

The invention relates generally to skating equipment but more particularly to equipment used in teaching or training skaters.

2. Background of the Invention

There are a number of devices that have been developed over the years to help people, young and old, to learn how to skate, usually ice skating, but in recent years patent applications have expanded their claims to cover the increasing poplularity of inline skating. For example U.S. Pat. No. 3,235,254 by Robson and U.S. Pat. No. 5,120,286 by Twohig disclose devices aimed at beginners, there are of course many more such devices which do not apply to the specific function of the invention herein described. In a related field, ice hockey requires for players to have a quick start, strong accelerations and fast ongoing speed. To achieve that, it is important for the ankles to rotate a certain way and the legs to bend and to push at a certain angle and the center of gravity of the body to be at a certain point which can only be achieved if the torso is angled in a certain way. The optimal parameters for skating are known to those who study the sport but teaching and training players to adopt and maintain that optimal posture is the key to quick and efficient training and, as of now, there are no tools that can adequately do that.

Some inventions aspire at teaching optimal skating for hockey such as U.S. Pat. No. 4,915,373 by Walker which is a static exercise machine for skaters and is not meant for use on an ice surface but rather as part of a training program in a gym or such place. U.S. Pat. No. 5,911,650 also discloses a static training machine for use in a gym or such place and U.S. Pat. No. 6,090,015 is mostly concerned with practicing turns for skaters and skiers with the machine base being static and the users being able to rotate around it by leaning on a rotating boom arm. Although strength training in general and skate simulation machine such as U.S. Pat. No. 5,911,650 are useful in the training process, nothing beats actual training on the actual playing field with the actual footwear and equipment to really train the muscle groups and train the neuro-muscular system of an athlete.

Althought some of the prior art appears to have common elements such as sternum support and adjustable vertical posts, the nature and operation of the device herein disclosed is substantially different from the prior art of record.

SUMMARY OF THE INVENTION

The present invention discloses a skating training device for use on an ice surface such as an ice rink when training for ice skating and can also be adapted for use on any flat hard surface when used for training for roller skates of all kinds.

It is a first object of this invention to provide for a simple to use skating training device aimed at improving the skating style of a skater.

It is a second object of this invention to provide a skating training device aimed at strenghtening and conditioning the muscles involved in skating.

It is a final object of this invention to provide a skating training device that can be adjusted easily to configure exactly to any skater no matter the length of their arms, legs, torso and no matter their physical strength.

In order to do that, the device consists of a base plate that slides on the ice—or rolls on any other less slippery surface—and is made of a series of telescoping adjustable rods and the said device can also accept weight plates to adjust the level of strength required to push it while practicing skating movements. A user happies his sternum against a sternum support and can also hold handle bars and skates against the resistance provided by the weighted down device. Provisions are also made to have two sternum supports so that two users facing each other each apply their sternums against their sternum support thus pushing one against the other.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

DETAILED DESCRIPTION OF THE PREFERRED EMBODIMENT

Figure 1:
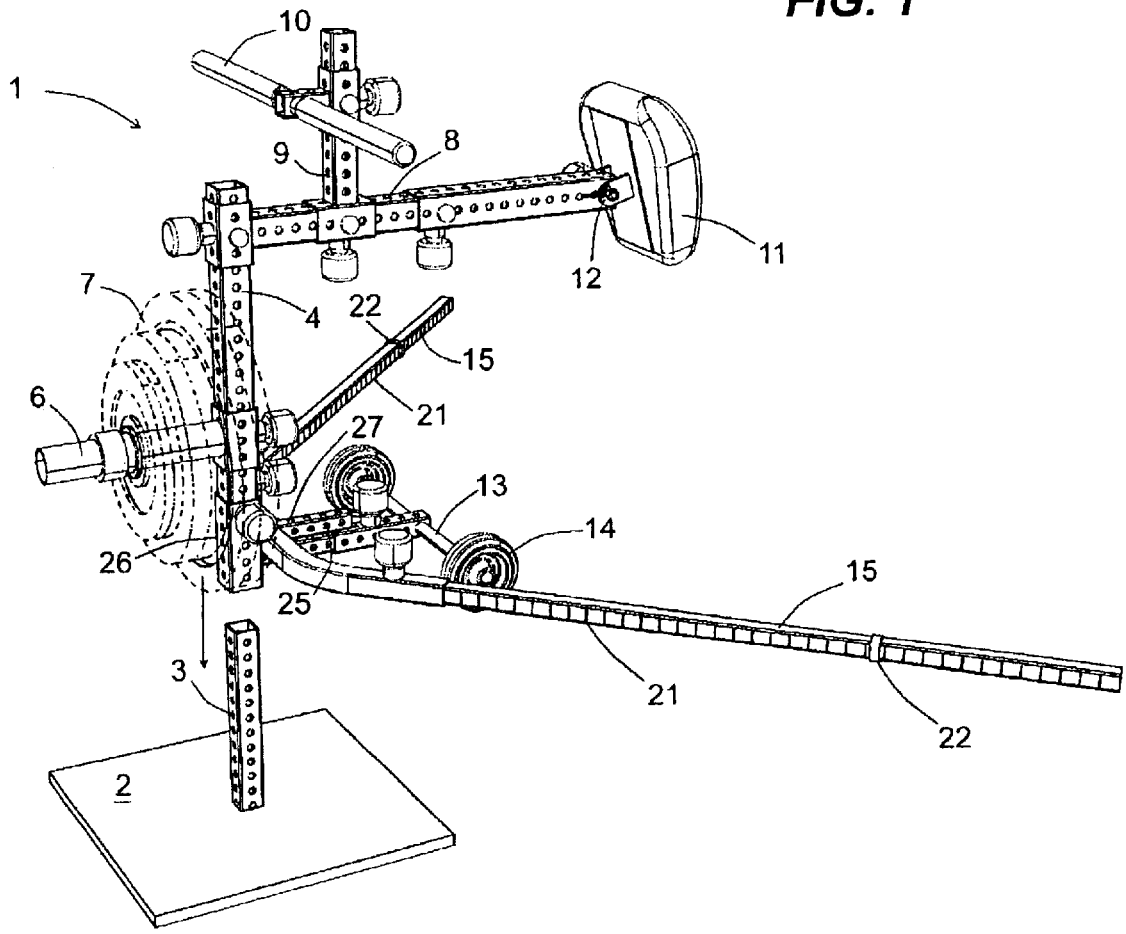
FIG. 1 Is an isometric view of the device favoring one side.

FIG. 1 A skating training aid 1 is comprised of a base plate 2 which lays flat on a surface, has a base post 3 which emerges perpendicularity therefrom and around which is slidably attached a main post 4. Moving upward on that main post 4, we come across an arc module 25 slidably attached to the main post 4, which will be described later. From that main post 4, continuing upward, we come across a weight plate support rod 6 onto which weight plates 7 can be slid and said weight plate support rod 6 is perpendicular to the main post 4 onto which it is slidably attached. Further up, we come across a telescoping transverse arm 8 which is also set perpendicular to the main post 4 and to which it is also slidably attached to. From the transverse arm 8 going to its distal end, we come across a handle bar post 9 set perpendicular to the transverse arm 8, pointing upward and slidably attached to it. From the handle bar post 9 we move upward until we come across the handle bar 10 which is also slidably engaged therefrom. Back to the transverse arm 8, we continue toward the distal end where the telescoping part of the said telescoping transverse arm 8 terminates with a sternum support 11 which is rotationally engaged to the said telescoping transverse arm 8. Optionally, an angle indicator 12 is fixedly attached to the sternum support 11 in order to indicate its angle of inclination from the vertical. The above recited parts which are described as slidably engaged onto another part are also described as <<slidably attached elements>> throughout this description when referred to generally.

The arc module 25 is comprised of an arc part 25, a connector part 26 and an arc rod. The connector part 26 slidably engages the main post 4 and the connector part 26 has the arc rod 27 fixedly attached to it and extending perpendicularly therefrom. The arc part 25 has two extremities and at each extremity, guiding rods 15 are releasably inserted. Slidingly engaging each of the guiding rods 15 is a cursor 22 which acts as a marker to aid in instructing footwork, along with indicias 21. The arc part 25 can be adjusted proximally or distally from the connector part 26 along the length of the arc rod 27.

A telescoping wheel support rod 23 is also fixedly attached to the connector part 26 at its proximal end and at its distal end is an axle 13 extending perpendicularly therefrom. The axle 13 has two opposite extremities and each extremity has one wheel 14. The wheels 14 are used for transporting the skating training aid 1 by simply tilting it to engage the wheels 14 to the ground. Being telescopic, the telescoping wheel support rod 23 can set the wheels 14 at different distances from the connector part 26. The base plate 2 is specially coated to reduce stickiness and damage to an ice surface. The guiding rods 15 help a user with the proper motion of the legs and can be removed for a more advanced user. Weight plates 7 can be inserted directly atop the base plate by removing the arc module 5 and weight plates 7 can also be placed, of course, on the support rod 6 for a maximum workout. The angle indicator 12 monitors the exact angle for future reference as do indicias 21 all along the main post 4, the telescoping transverse arm 8, the handle bar post 9 and the guiding rods 15. With these indicias 21 many users can use the skating training aid 1 on any given day and use it again some other day by reconfiguring it to their specifications based on these indicias 21 and they are relied upon to gauge progress as the posture improves and different adjustements force the user into the optimal body posture.

Figure 2:
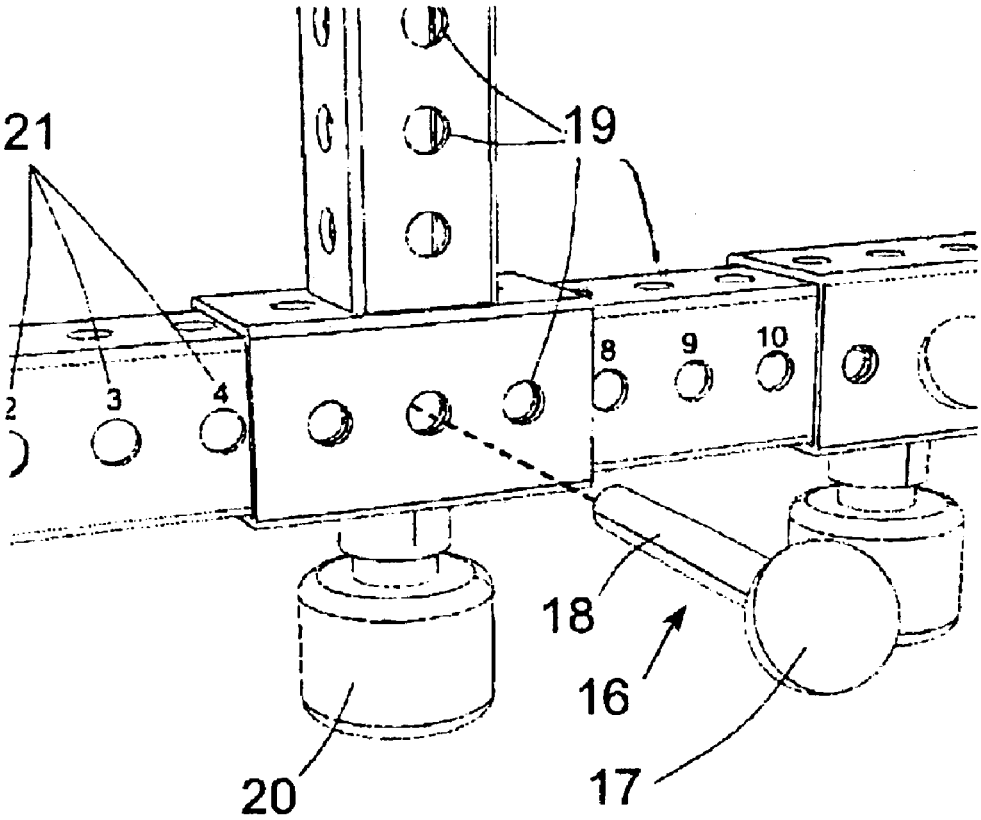
FIG. 2 Is a close up isometric view showing the pin insertion.

FIG. 2 As can be appreciated, most of the discrete parts are slidably attached to one another and can be locked into position by either a system of holes and pins, which is quite familiar in the art of sports and fitness training equipment or, as in the remaining figures, it can use a system of lock that does not require holes which will be discussed in the next figure. The pin and holes system operates with a pin 16 comprised of a head 17 and a shaft 18. The shaft is inserted through a series of aligned holes 19 of two slidably attached elements. This allows for the various elements to adapt to the measurements of a user in particular. In order to secure the pin 16 in place, the head 17 is magnetized so that it will "stick" to the place it is inserted to (assuming of course that the device is made of magnetically compatible material such as steel). Of course the pins 16 as described herein could be substituted by pull-pin or spring loaded pin as commonly used in this type of training equipment. Since the telescoping and slidably attached elements need to have a little play between them in order to slide smoothly and with ease, this has the drawback of causing the slidably attached elements to wiggle. In order to eliminate this, at each location this occurs, there is a knob 20 that, with a small rotation, will tighten the two slidalby attached elements and resolve the wiggling problem. The quarter turn system described in the copending application allows for the locking down of a given position and resolves the wiggling problem in a single quarter turn (quarter turn being a figure of speech to generally describe the action and should not be taken literally).

Figure 3:
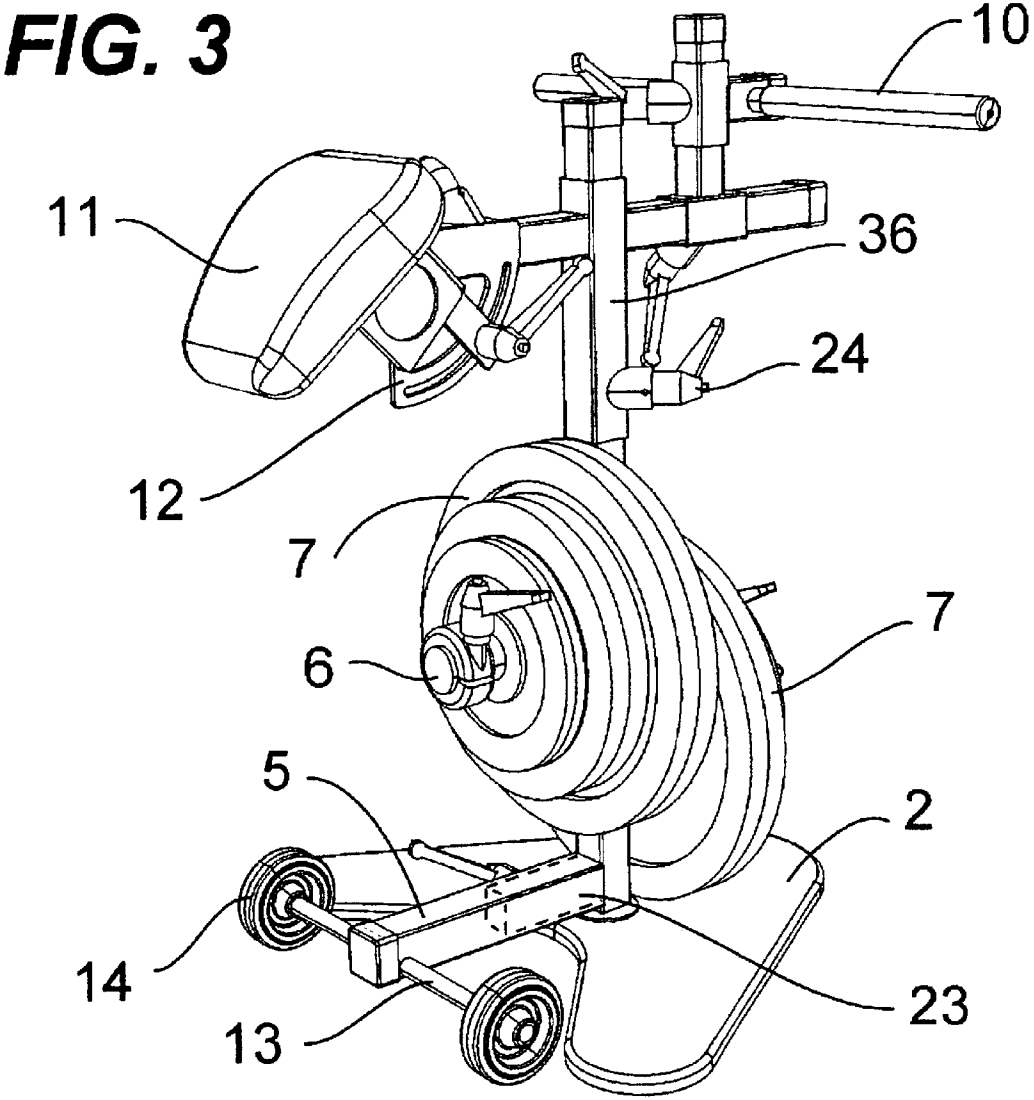
FIG. 3 Is an isometric view of the device with an alternate locking system.

FIG. 3 This embodiment features a no holes 19 look and has a more elaborate angle indicator 12 the remaining parts are essentially the same. It should be noted, however that the telescoping transverse arm 8 as found in FIG. 1 has become a <<T>> telescoping arm 36, but this <<T>> telescoping arm 36 can be found on the embodiement of FIG. 1 as well as the telescoping arm 8 can be substituted in this figure. The <<T>> telescoping arm 36 allows for the sternum support 11 to be set closer to the main post 4 since the handles 10 are situated on the other side of that very same main post 4. The no holes 19 look is described in a copending application by this inventor, essentially, it consists of locking handles 24 requiring a quarter turn in order to loosen or lock the discrete slidably attached elements. It should be noted that in this figure, there is more than one weight support rod 6 which increases the amount of possible weights 7 that can be put on skating training aid 1. Also, the telescoping wheel support rod 23 is fixedly engaged to the main post 4 at its proximal end and at its distal end is the axle 13 extending perpendicularly therefrom.

Figure 4:
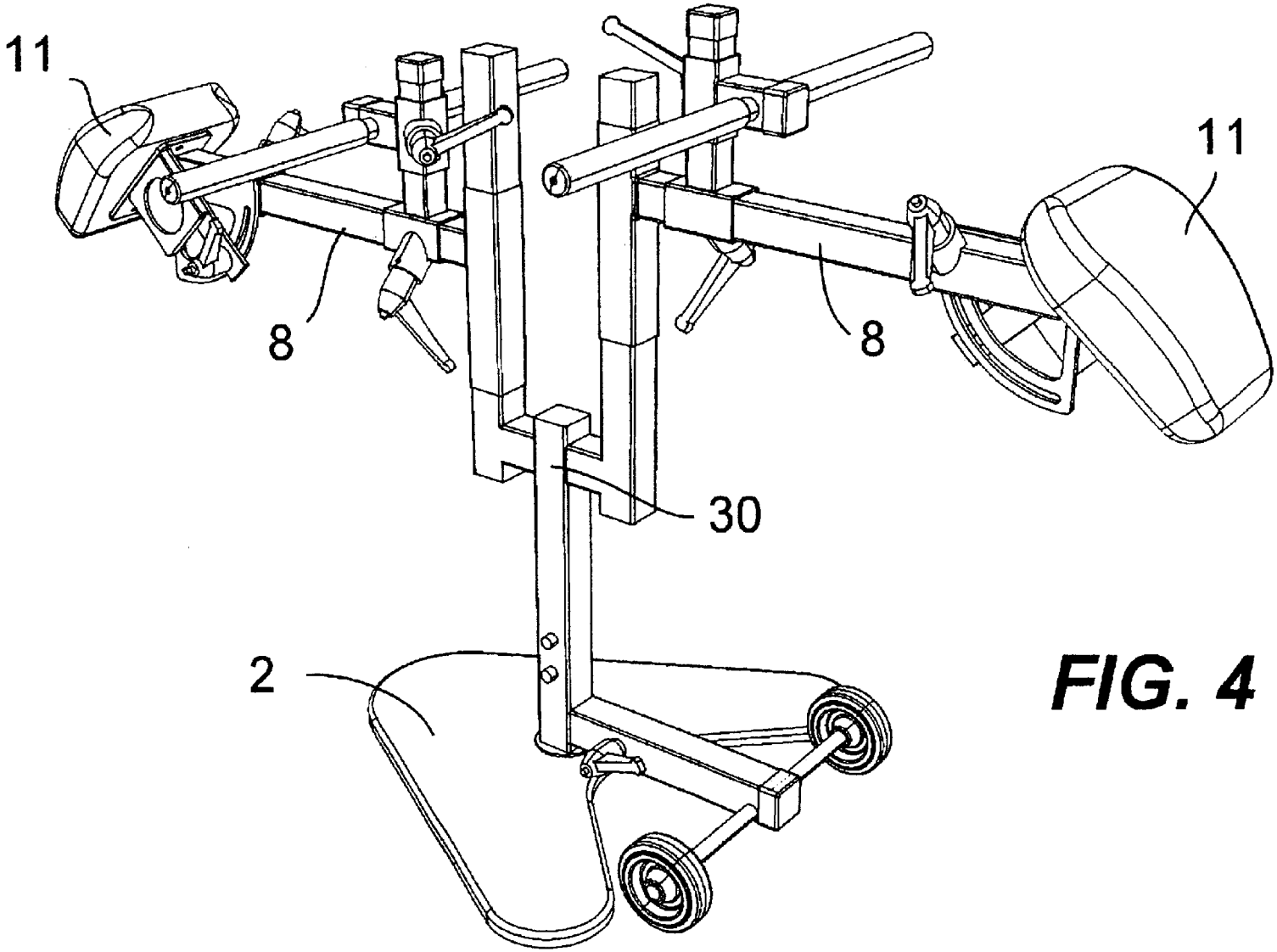
FIG. 4 Is an isometric view of the device with a double sternum support arrangement.

FIG. 4A variation of the skating training aid 1 has a <<Y>> shape fitting 30 which slidably engages the main post 3 in lieu of the main post 4 and each arm of the <<Y>> receives a telescoping transverse arm 8 and each telescoping transverse arm 8 receives a sternum support 11. This way, two opposing people can work against each other.

Figure 5:
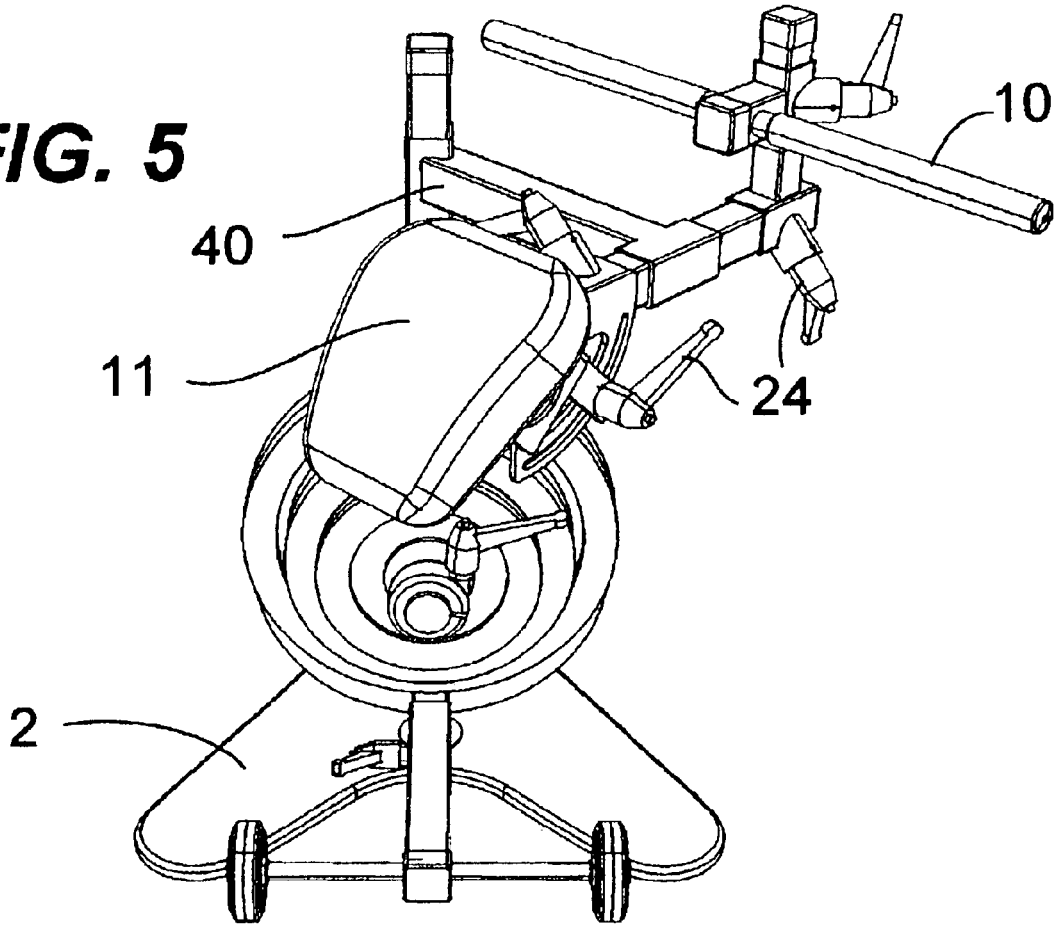
FIG. 5 Is an isometric view of the device with an angled sternum support.

FIG. 5 Another variation provides the skating training aid 1 with an angled attachment 40 which allows for training one leg at a time for a quick start in which case the left foot would point forward towards the front of the machine while the right foot would be at a right angle to the left foot and provide the motion. The torso of the user is set at an angle of about 30 degrees in relation to the right foot, which is the correct angle for a stride. After having trained one leg, the angle attachment 40 can be removed, flipped over and reinserted to exercize the left leg this time.

Figure 6:
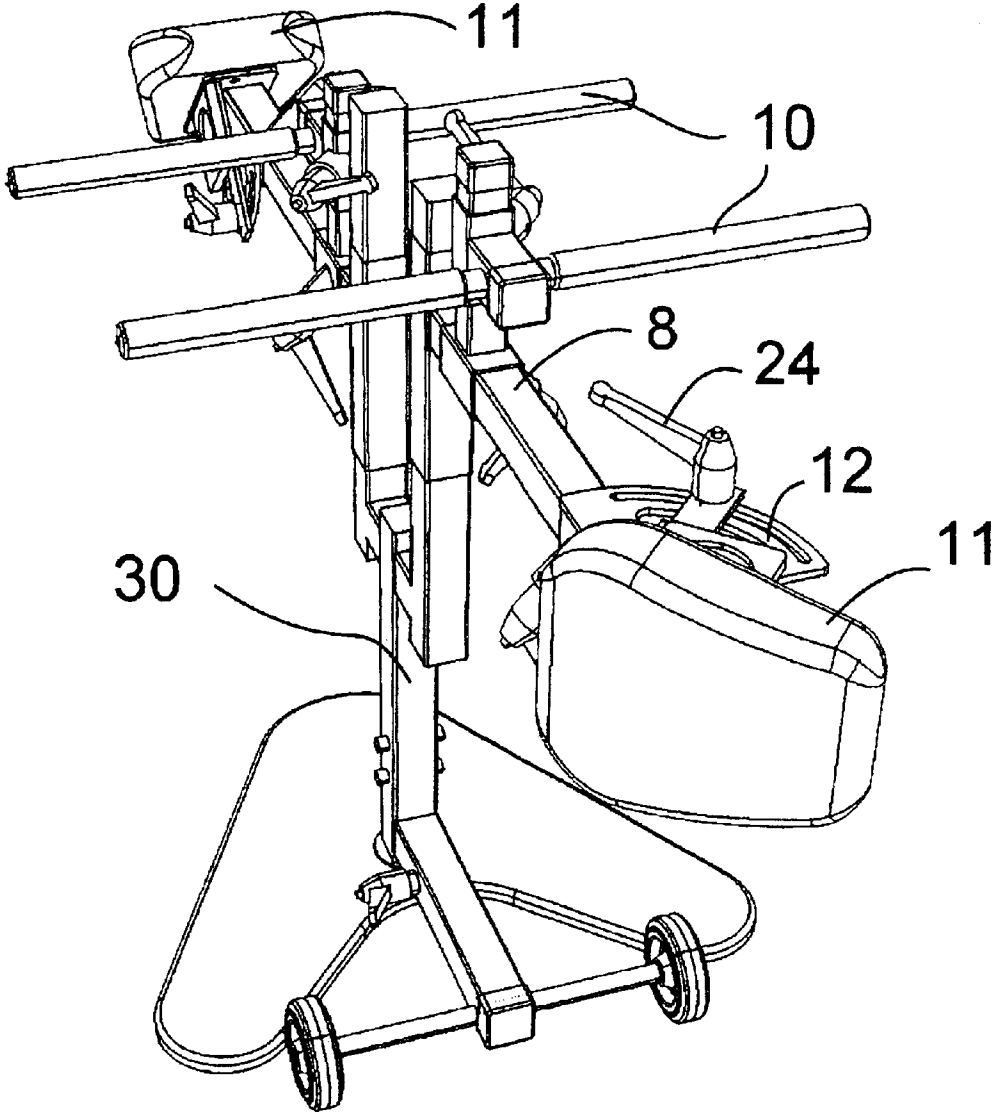
FIG. 6 Is an isometric view as in 5 but with one of the sternum support turned sideways.

FIG. 6 The sternum support 11 can be turned sideways which allows the angle to be varied horizontally and provide some of the same benefit as the angled attachment 40 of FIG. 5 but for practicing skating stride one leg at a time as oppposed to quick starts.

Figure 7:
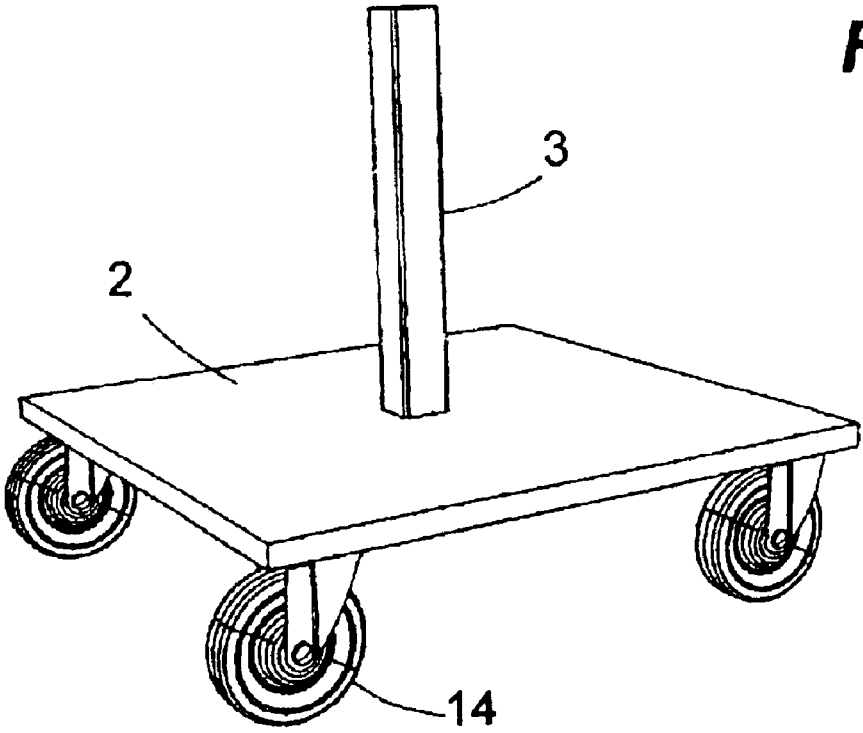
FIG. 7 Is an isometric view of the base plate adapted for the needs of off ice use.

FIG. 7 In an alternate embodiment, a different base plate 2 has a base post 3 and a plurality of wheels 14 to allow it to roll off non slippery surface to train on roller skates.

What is claimed:

1. A skating training aid to train skaters comprising:

a base plate, a base post emerging perpendicularly from the said base plate;

a main post slidably attached to the said base post;

a weight plate support rod, onto which weight plates can be slid, slidably engaged in a generally perpendicular fashion with the said main post;

a telescoping transverse arm slidably engaged in a generally perpendicular fashion with the said main post;

a handle bar post slidably engaged in a generally perpendicular fashion with the said transverse arm;

handlebars slidably engaged in a generally perpendicular fashion with the said handle bar post;

the telescoping transverse arm having a telescoping part extending therefrom and having a distal end onto which is rotationally attached a sternum support.

2. A skating training aid as described in claim 1 further comprised of;

an angle indicator fixedly attached to the sternum support to indicate the angle of the said sternum support.

3. A skating training aid as described in claim 1 further comprised of;

an arc module comprised of an arc part, a connector part and an arc rod;

the connector part slidably engaging the main post and the connector part having the arc rod fixedly attached thereto and extending perpendicularly therefrom;

the said arc part having two extremities and at each of the said extremity, releasably inserted guiding rods.

4. A skating training aid as described in claim 3 further comprised of;

a cursor acting as a marker slidingly engaging each of the guiding rods;

the said guiding rods having indicias.

5. A skating training aid as described in claim 3 wherein the arc part is adjustable proximally or distally from the connector part along the length of the arc rod.

6. A skating training aid as described in claim 1 further comprised of;

a base plate having at least three wheels or rotational support of any kind to allow said base plate to roll on a surface.

7. A skating training aid as described in claim 1 having the following method of use:

a user applies his sternum against a sternum support, he can also hold handle bars, and skates against the resistance provided by the weighted down said skating training aid.

8. A skating training aid as described in claim 1 further comprised of;

a telescoping wheel support rod fixedly attached to a connector part at its proximal end and at its distal end an axle extending perpendicularly therefrom;

the said axle having two opposite extremities and each extremity having one wheel.

9. A skating training aid as described in claim 8 further comprised of;

a telescoping wheel support rod to adjust the wheels at different distances from the connector part.

10. A skating training aid as described in claim 1 whereas;

the telescoping wheel support rod is fixedly engaged to the main post at its proximal end.

11. A skating training aid as described in claim 1 further comprised of;

an angled attachment slidably engaged in a generally perpendicular fashion as per the vertical with the main post but having a horizontal angle which offsets the said angled attachment in relation with the weight plate support rod.

12. A skating training aid as described in claim 1 whereas;

an alternate telescoping transverse arm in the shape of a <<T>> so that the sternum support can be on one side of the main post while the handle bar can be on the other side of the said main post.

13. A skating training aid as described in claim 1 further comprised of;

a <<Y>> shape fitting which receives telescoping transverse arms and onto which can be attached a pair of sternum supports for opposing two people against each other.

14. A skating training aid as described in claim 13 having the following method of use:

two users facing each other each apply their sternums against their sternum support thus pushing one user against the other.

* * * * *